US011541978B2

(12) United States Patent
Teshima et al.

(10) Patent No.: US 11,541,978 B2
(45) Date of Patent: Jan. 3, 2023

(54) JET PROPELLED BOAT

(71) Applicant: YAMAHA HATSUDOKI KABUSHIKI KAISHA, Iwata (JP)

(72) Inventors: Shigeyuki Teshima, Shizuoka (JP); Kaori Inoue, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 230 days.

(21) Appl. No.: 17/174,420

(22) Filed: Feb. 12, 2021

(65) Prior Publication Data

US 2021/0269134 A1 Sep. 2, 2021

(30) Foreign Application Priority Data

Feb. 28, 2020 (JP) ..... JP2020-034329

(51) Int. Cl.

| | |
|---|---|
| ***B63H 11/02*** | (2006.01) |
| ***B63B 3/48*** | (2006.01) |
| ***B63B 1/04*** | (2006.01) |
| ***B63B 34/10*** | (2020.01) |

(52) U.S. Cl.

CPC ..... *B63H 11/02* (2013.01); *B63B 1/04* (2013.01); *B63B 3/48* (2013.01); *B63B 34/10* (2020.02)

(58) Field of Classification Search

CPC .. B63H 11/02; B63B 1/04; B63B 3/48; B63B 34/10

See application file for complete search history.

(56) References Cited

U.S. PATENT DOCUMENTS

| | | | | |
|---|---|---|---|---|
| 7,918,173 | B2 * | 4/2011 | Duquette | B63B 34/10 114/55.57 |
| 8,146,524 | B1 * | 4/2012 | Cote | B62J 1/12 114/55.57 |
| 2003/0047125 | A1 * | 3/2003 | Cassell | B63B 29/02 114/364 |
| 2008/0293311 | A1 | 11/2008 | Miguchi | |

FOREIGN PATENT DOCUMENTS

| | | | | |
|---|---|---|---|---|
| JP | 2008-291774 | A | 12/2008 | |
| JP | 2011088524 | A * | 5/2011 | B63B 35/731 |

* cited by examiner

*Primary Examiner* — Anthony D Wiest

(74) *Attorney, Agent, or Firm* — Keating and Bennett, LLP

(57) ABSTRACT

A jet propelled boat includes a boat body including a hull and a deck located above the hull, and a pair of frames, one frame provided on each of a right side and a left side of the deck so as to sandwich the deck in a right-left direction of the jet propelled boat. The deck includes an upper deck and a lower deck, and each of the pair of frames includes a connector that spans the upper deck and the lower deck so as to connect the upper deck to the lower deck.

16 Claims, 3 Drawing Sheets

90-90 CROSS-SECTION

JET PROPELLED BOAT

CROSS REFERENCE TO RELATED APPLICATIONS

This application claims the benefit of priority to Japanese Patent Application No. 2020-034329 filed on Feb. 28, 2020. The entire contents of this application are hereby incorporated herein by reference.

BACKGROUND OF THE INVENTION

1. Field of the Invention

The present invention relates to a jet propelled boat, and more particularly, it relates to a jet propelled boat including a boat body including a hull and a deck.

2. Description of the Related Art

A jet propelled boat including a boat body including a hull and a deck is known in general. Such a jet propelled boat is disclosed in Japanese Patent Laid-Open No. 2008-291774, for example.

Japanese Patent Laid-Open No. 2008-291774 discloses a jet propelled boat including a boat body including a hull and a deck. The deck includes a lower deck located above the hull and an upper deck located above the lower deck. The lower deck is larger than the upper deck in a right-left direction.

Conventionally, in the field of a jet propelled boat including structures disclosed in Japanese Patent Laid-Open No. 2008-291774, it is desired to improve the strength of a deck that encounters wind resistance and water resistance (resistance due to splashing) that is applied according to the operating state of the jet propelled boat.

SUMMARY OF THE INVENTION

Preferred embodiments of the present invention provide jet propelled boats that improve the strength of decks.

A jet propelled boat according to a preferred embodiment of the present invention includes a boat body including a hull and a deck located above the hull, and a pair of frames provided respectively on a right side and a left side of the deck so as to sandwich the deck in a right-left direction of the jet propelled boat. The deck includes an upper deck and a lower deck, and each of the pair of frames includes a connector to connect the upper deck to the lower deck.

A jet propelled boat according to a preferred embodiment of the present invention includes the pair of frames provided respectively on the right side and the left side of the deck so as to sandwich the deck in the right-left direction of the jet propelled boat and including the connector to connect the upper deck to the lower deck. Accordingly, the connector of each of pair of frames spans the upper deck and the lower deck on both of the right and left sides of the deck, and thus the upper deck and the lower deck are less likely to mutually deform. Consequently, even when the deck encounters water resistance or wind resistance depending on the operating state of the jet propelled boat, the deck is less likely to deform, and thus the strength of the deck is improved.

In a jet propelled boat according to a preferred embodiment of the present invention, the lower deck is preferably larger than the upper deck in the right-left direction, and the connector of each of the pair of frames is preferably inclined downward and outward in a front view of the jet propelled boat. Accordingly, the lower deck and the upper deck are connected to each other by the connectors on the upper end sides of the lower deck and the right-left end sides of the upper deck, and thus the upper deck and the lower deck are less likely to deform. Consequently, the strength of the deck is further improved.

A jet propelled boat according to a preferred embodiment of the present invention preferably further includes an opening provided in each of the pair of frames and defined by a side surface of the upper deck, an upper surface of the lower deck, and an inner surface of the connector of each of the pair of frames that faces the deck. Accordingly, wind passes through the opening from the front side such that wind resistance encountered by the deck is reduced.

In a jet propelled boat according to a preferred embodiment of the present invention, the connector of each of the pair of frames is preferably inclined forward and downward toward a lower side of the jet propelled boat. Accordingly, the connectors are located so as to not easily interfere with the lower limbs of a user that protrude forward.

In a jet propelled boat according to a preferred embodiment of the present invention, the pair of frames preferably define a cowling together with a front portion of the upper deck. Accordingly, the pair of frames improve the strength of the deck, and significantly reduce or prevent exposure of the user to wind and water splash.

In a jet propelled boat according to a preferred embodiment of the present invention, each of the pair of frames preferably further includes an upper frame integral and unitary with the connector and located above the connector and along an outer surface of the upper deck, and a lower frame integral and unitary with the connector and located below the connector and along an outer surface of the lower deck. Accordingly, a connection of the connectors to each of the upper deck and the lower deck is reinforced by the upper frame and the lower frame, and thus the connectors more securely connect the upper deck and the lower deck.

In such a case, the lower frame of each of the pair of frames preferably includes an outer surface flush or substantially flush with the outer surface of the lower deck. Accordingly, wind resistance generated at a boundary between the lower frame and the lower deck is substantially zero.

In a jet propelled boat including the frames each including the upper frame and the lower frame, each of the pair of frames preferably further includes a rear frame connected to a rear side of the upper frame and extending rearward so as to cover the outer surface of the upper deck. Accordingly, the rear frame covers the outer surface of the upper deck, and thus the strength of the upper deck is further improved.

In a jet propelled boat according to a preferred embodiment of the present invention, the connector of each of the pair of frames preferably becomes thicker as the connector extends upward toward an upper side of the jet propelled boat. Accordingly, the connectors become thicker toward the upper deck, which may easily deform, as compared with the lower deck that is installed on the hull and harder to deform. Therefore, deformation of the upper deck is effectively significantly reduced or prevented such that the strength of the deck is effectively improved.

In a jet propelled boat including the opening defined by the side surface of the upper deck, the upper surface of the lower deck, and the inner surface of the connector, the side surface of the upper deck that defines the opening is preferably concave so as to be recessed inward. Accordingly, the opening is larger as compared with a case in which the side surface of the upper deck that defines the opening is convex, and thus more air passes through the opening. Therefore, wind resistance encountered by the deck is further reduced.

In such a case, the concave side surface of the upper deck that defines the opening is preferably arcuate. Accordingly, as compared with a case in which the concave side surface of the upper deck has a shape with corners, stress concentration on the upper deck is significantly reduced or prevented, and thus the strength of the deck is further improved.

In a jet propelled boat according to a preferred embodiment of the present invention, the pair of frames preferably have a V-shape so as to be spaced farther apart from each other as the pair of frames extend toward a front side of the jet propelled boat in a plan view. Accordingly, as compared with a case in which the pair of frames extend only in an upward-downward direction of the jet propelled boat or only in the right-left direction in the plan view, the frames are installed over a relatively large range in the plan view, and thus the deck is reinforced over a relatively large range in the plan view.

In a jet propelled boat according to a preferred embodiment of the present invention, the connector of each of the pair of frames preferably includes an outer surface that is convex so as to bulge outward in a horizontal cross-section of the jet propelled boat. Accordingly, the mechanical strength of the deck is improved as compared with a case in which the outer surface is flat.

In such a case, the convex outer surface preferably includes two concave surfaces aligned in a forward-rearward direction of the jet propelled boat and recessed inward in the horizontal cross-section, and one convex portion that connects the two concave surfaces and bulges outward in the horizontal cross-section. Accordingly, a convex connector that bulges outward is easily provided.

In a jet propelled boat according to a preferred embodiment of the present invention, the deck preferably further includes a footrest to enable a user to place his or her foot thereon, and the connector of each of the pair of frames is preferably located on a front side of the footrest in a forward-rearward direction of the jet propelled boat. Accordingly, the connectors are located on the front side of the footrests such that exposure of the lower limbs of the user to wind is reliably significantly reduced or prevented.

A jet propelled boat according to a preferred embodiment of the present invention preferably further includes a pair of reinforcing ribs aligned in the right-left direction so as to extend in an upward-downward direction of the jet propelled boat at a front end of the deck between the pair of frames in a front view. Accordingly, in addition to the strength of the deck on both of the right and left sides, the strength of the deck on the front side is improved by the reinforcing ribs, and thus the strength of the deck is further improved.

In such a case, the pair of reinforcing ribs are preferably extend outward and downward away from each other toward a lower side of the jet propelled boat. Accordingly, the reinforcing ribs reinforce the deck more effectively.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a jet propelled boat 100 according to preferred embodiments of the present invention is now described with reference to FIGS. 1 to 6.

In the figures, each direction is shown with reference to the jet propelled boat 100. That is, the forward movement direction (front side) of the jet propelled boat 100 is represented by arrow FWD, and the rearward movement direction (rear side) of the jet propelled boat 100 is represented by arrow BWD. Furthermore, a right direction (right side) with respect to the forward movement direction of the jet propelled boat 100 is represented by arrow R, and a left direction (left side) with respect to the forward movement direction of the jet propelled boat 100 is represented by arrow L. An upward-downward direction is represented by arrow Z, an upward direction (upper side) is represented by arrow Z1, and a downward direction (lower side) is represented by arrow Z2.

Figure 1:
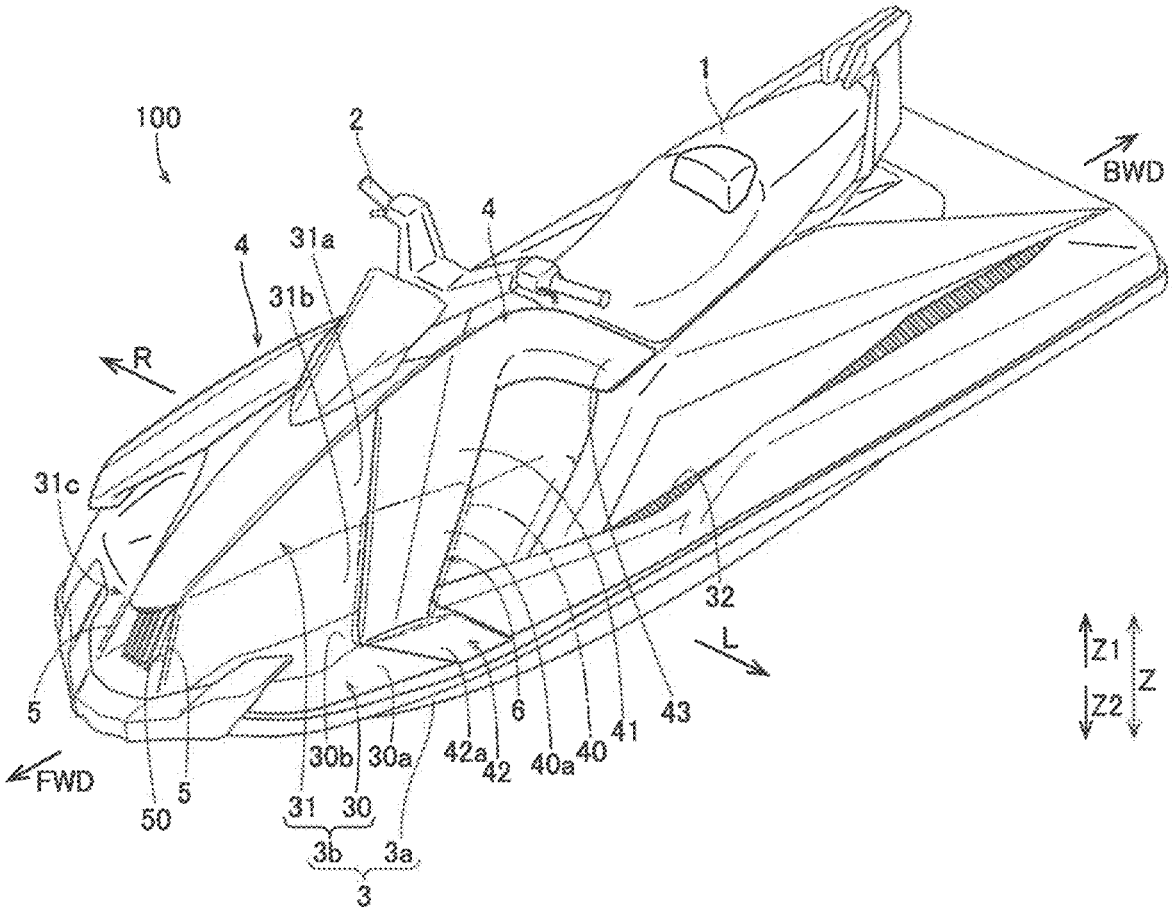
FIG. 1 is a perspective view showing a jet propelled boat according to a preferred embodiment of the present invention, as viewed from the front side.
Figure 2:
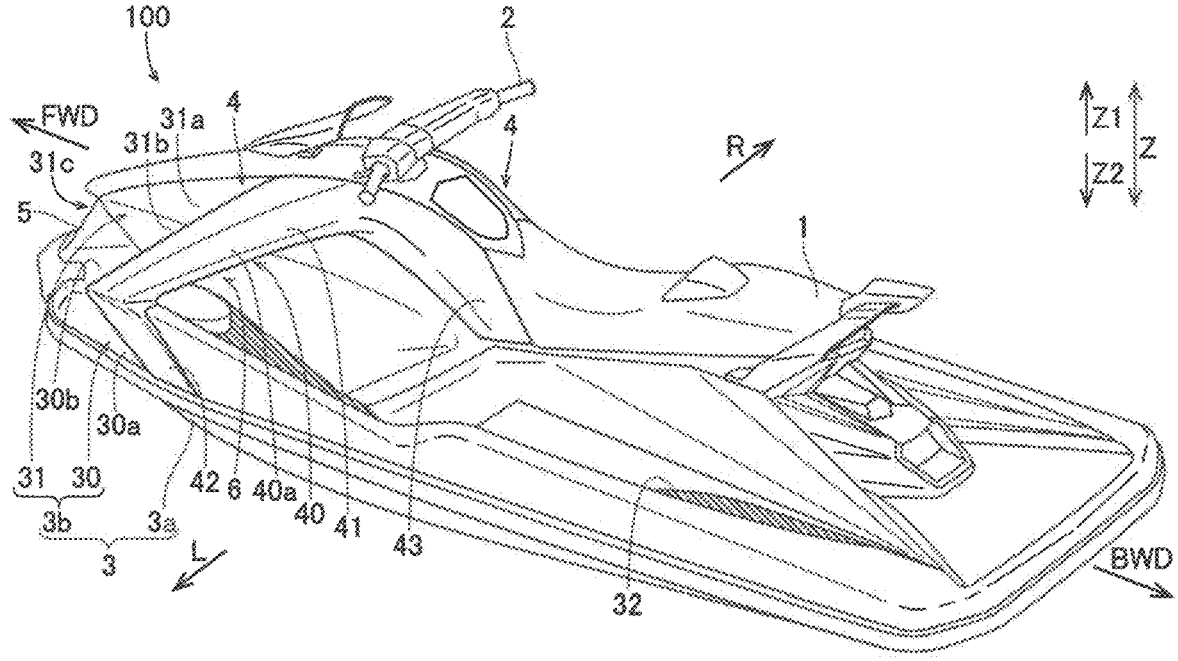
FIG. 2 is a perspective view showing a jet propelled boat according to a preferred embodiment of the present invention, as viewed from the rear side.
Figure 3:
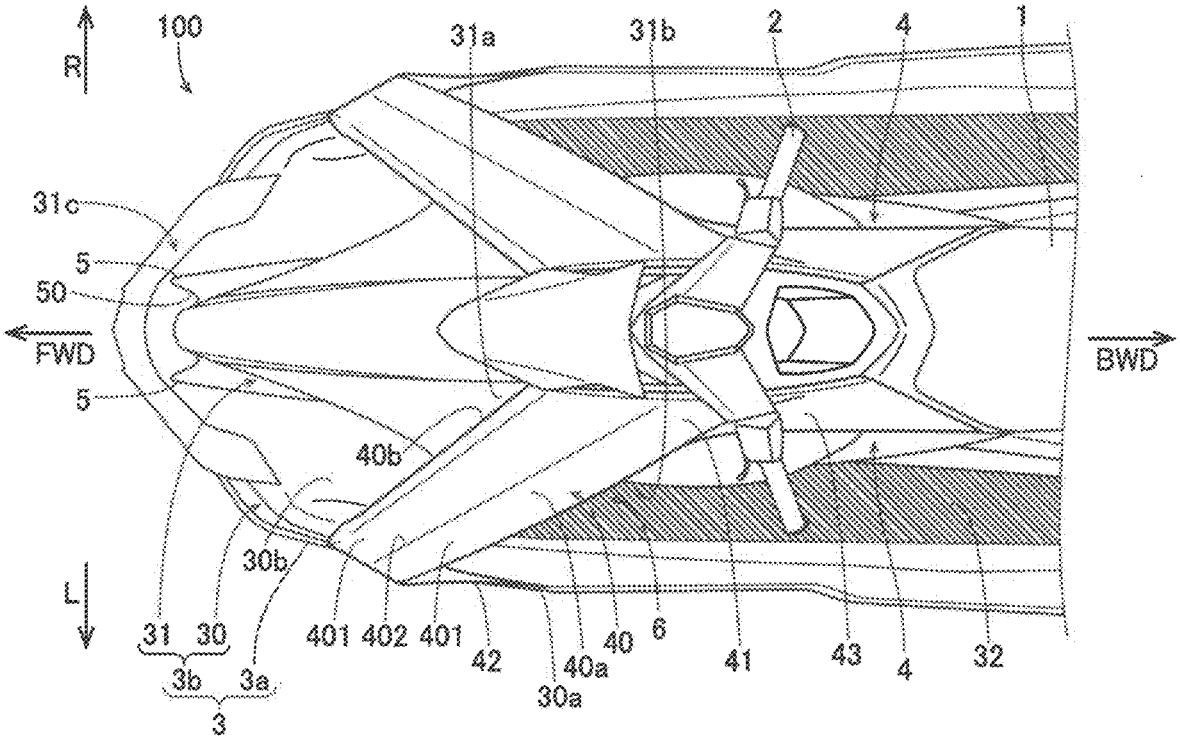
FIG. 3 is a plan view of a jet propelled boat according to a preferred embodiment of the present invention.

As shown in FIGS. 1 and 2, the jet propelled boat 100 includes a seat 1, a handle 2, a boat body 3 including a hull 3*a* and a deck 3*b*, a pair of frames 4 installed (fixed) on the deck 3*b*, and reinforcing ribs 5 provided at a front end (front portion 31*c*) of the deck 3*b*.

The jet propelled boat 100 includes through-holes 6 between the frames 4 and the deck 3*b*. The through-holes 6 are examples of an "opening".

The handle 2 and the seat 1 are installed on an upper portion of the boat body 3. Various components such as an engine (not shown) and a fuel tank (not shown) are housed in the boat body 3. The handle 2 includes a function to adjust the output of the engine. Furthermore, the handle 2 includes a function to adjust the propulsion direction of the jet propelled boat 100. The seat 1 (jet propelled boat 100) is a two-seater, for example.

The hull 3*a* defines a lower portion of the boat body 3 and floats on the water surface. The hull 3*a* mainly contacts the water during propulsion of the jet propelled boat 100 and encounters resistance from the water.

The deck 3*b* defines an upper portion of the boat body 3 and is installed above the hull 3*a*. The deck 3*b* mainly hits the wind during propulsion of the jet propelled boat 100 and encounters resistance from the wind.

The deck 3*b* includes a lower deck 30, an upper deck 31 located above the lower deck 30, and footrests 32.

The lower deck 30 is larger than the upper deck 31 in a right-left direction. Specifically, the lower deck 30 protrudes from a lower end of the upper deck 31 to both of the left and right sides, and has an upside-down T-shape in a front view. Furthermore, in the front view, the size L1 of the lower deck 30 in the right-left direction is larger than the size L2 of the upper deck 31 in the right-left direction (see FIG. 5).

The footrests 32 are portions on which the feet of a user on the seat 1 are placed. One footrest 32 is provided on each of the right side and the left side of the seat 1. The footrests 32 each have an elongated shape that extends in a forward-rearward direction. The footrests 32 extend forward beyond a position of the handle 2 in the right-left direction. The footrests 32 are provided on the lower deck 30. Although FIGS. 1 to 3 do not show cross-sections, the footrests 32 are hatched for easy understanding.

One frame 4 is provided on each of the right side and the left side of the deck 3*b* so as to sandwich the deck 3*b* in the right-left direction. The frames 4 are installed on the deck 3*b* and reinforce the deck 3*b* from both sides in the right-left direction. The frames 4 are located forward of the center of the jet propelled boat 100 in the forward-rearward direction.

The pair of frames 4 (connectors 40 and upper frames 41) define a cowling (windshield) together with the front portion 31*c* of the upper deck 31. Furthermore, the pair of frames 4 have a V-shape so as to be spaced farther apart from each other as the pair of frames 4 extend toward the front side in a plan view (see FIG. 3). That is, the pair of frames 4 have a V-shape with the front side open in the plan view.

Each of the frames 4 integrally includes a connector 40, an upper frame 41, a lower frame 42, and a rear frame 43. As an example, the frames 4 may be made of an ABS resin.

The connectors 40 are located on the front sides of the footrests 32 in the forward-rearward direction. Therefore, the connectors 40 cover the feet (lower limbs) of the user on the seat 1 from the front side.

The connectors 40 are provided between the upper deck 31 and the lower deck 30 to connect the upper deck 31 to the lower deck 30. The connectors 40 are inclined downward and outward in the front view. That is, the left connector 40 and the right connector 40 are spaced farther apart from each other as the left connector 40 and the right connector 40 extend toward the lower side (downward). As an example, the connectors 40 are inclined at an angle of about 40 degrees with respect to a horizontal plane in the front view.

The connectors 40 are inclined so as to extend forward as the connectors 40 extend downward. That is, the connectors 40 are inclined so as to not interfere with the user's legs (lower limbs) even when the legs (lower limbs) of the user on the seat 1 protrude forward. As an example, the connectors 40 are inclined at an angle of about 15 degrees or more and about 45 degrees or less with respect to the horizontal plane in a side view (see FIG. 4).

The connectors 40 become thicker as the connectors 40 extend toward the upper side (upward). That is, the connectors 40 become thicker from the lower deck 30 toward the upper deck 31.

Figure 6:
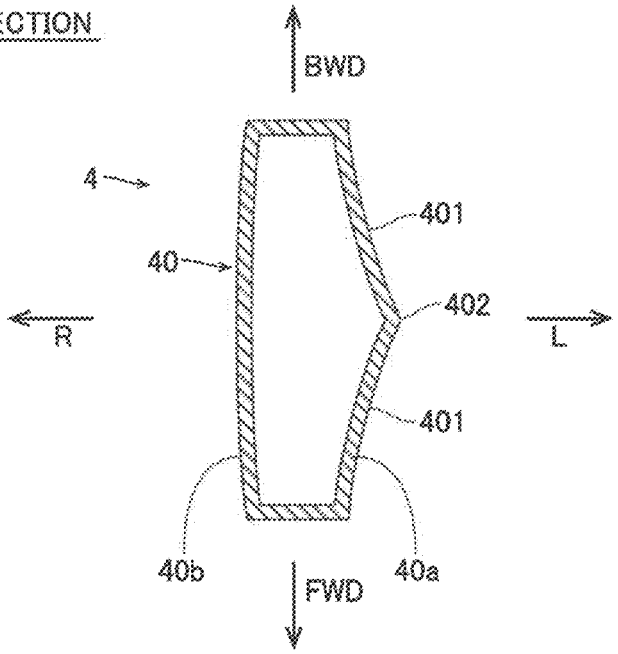
FIG. 6 is a sectional view taken along the line 90-90 in FIG. 5.

As shown in FIG. 6, the connectors 40 each include an outer surface 40*a* on the outer side, and the outer surface 40*a* is convex so as to bulge outward (in an L direction in FIG. 6) as a whole in a horizontal cross-section. Specifically, the convex outer surface 40*a* includes two concave surfaces 401 aligned in the forward-rearward direction and recessed inward in the horizontal cross-section, and one convex portion 402 that connects the two concave surfaces 401 and bulges outward in the horizontal cross-section. The concave surfaces 401 are smoothly curved.

As shown in FIG. 1, the upper frame 41 is integral and unitary with the connector 40 from above. The upper frame 41 is located above the connector 40 and extends along the outer surface 31*a* of the upper deck 31. That is, the upper frame 41 does not protrude significantly outward from the outer surface 31*a* of the upper deck 31 so as to not encounter high wind resistance.

The upper frame 41 extends in the same direction as the connector 40, and is continuous with the connector 40 seamlessly.

The lower frame 42 is integral and unitary with the connector 40 from below. The lower frame 42 is located below the connector 40 and extends along the outer surface 30*a* of the lower deck 30. The outer surface 42*a* of the lower frame 42 is flush or substantially flush with the outer surface 30*a* of the lower deck 30. That is, the lower frame 42 does not substantially protrude outward from the outer surface 31*a* of the upper deck 31 so as to not encounter high wind resistance.

The lower frame 42 is inclined so as to extend rearward as the lower frame 42 extends downward. Furthermore, the lower frame 42 extends substantially in the upward-downward direction without being inclined in the front view. At a connection point between the lower frame 42 and the connector 40, the rear portion protrudes outward in the plan view.

The rear frame 43 is connected to the upper frame 41 from the rear side. The rear frame 43 extends rearward so as to cover the outer surface 31*a* of the upper deck 31. The rear frame 43 is located adjacent to the seat 1 and extends along the seat 1. Specifically, the rear frame 43 is inclined so as to extend rearward as the rear frame 43 extends downward. Most of the rear frame 43 is located rearward of the handle 2.

Figure 4:
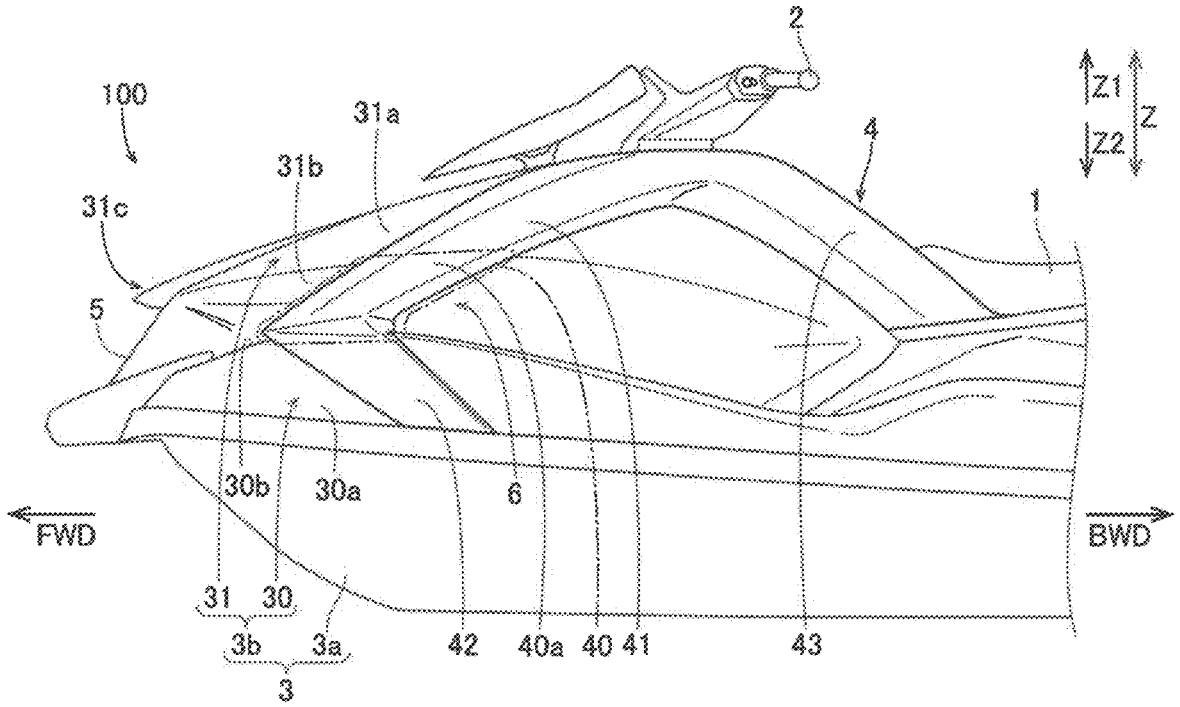
FIG. 4 is a side view of a jet propelled boat according to a preferred embodiment of the present invention.

The connector 40, the upper frame 41, and the lower frame 42 define a V-shape with the rear side open in the side view (see FIG. 4). Furthermore, the connector 40, the upper frame 41, and the rear frame 43 define a V-shape with the lower side open in the side view.

Figure 5:
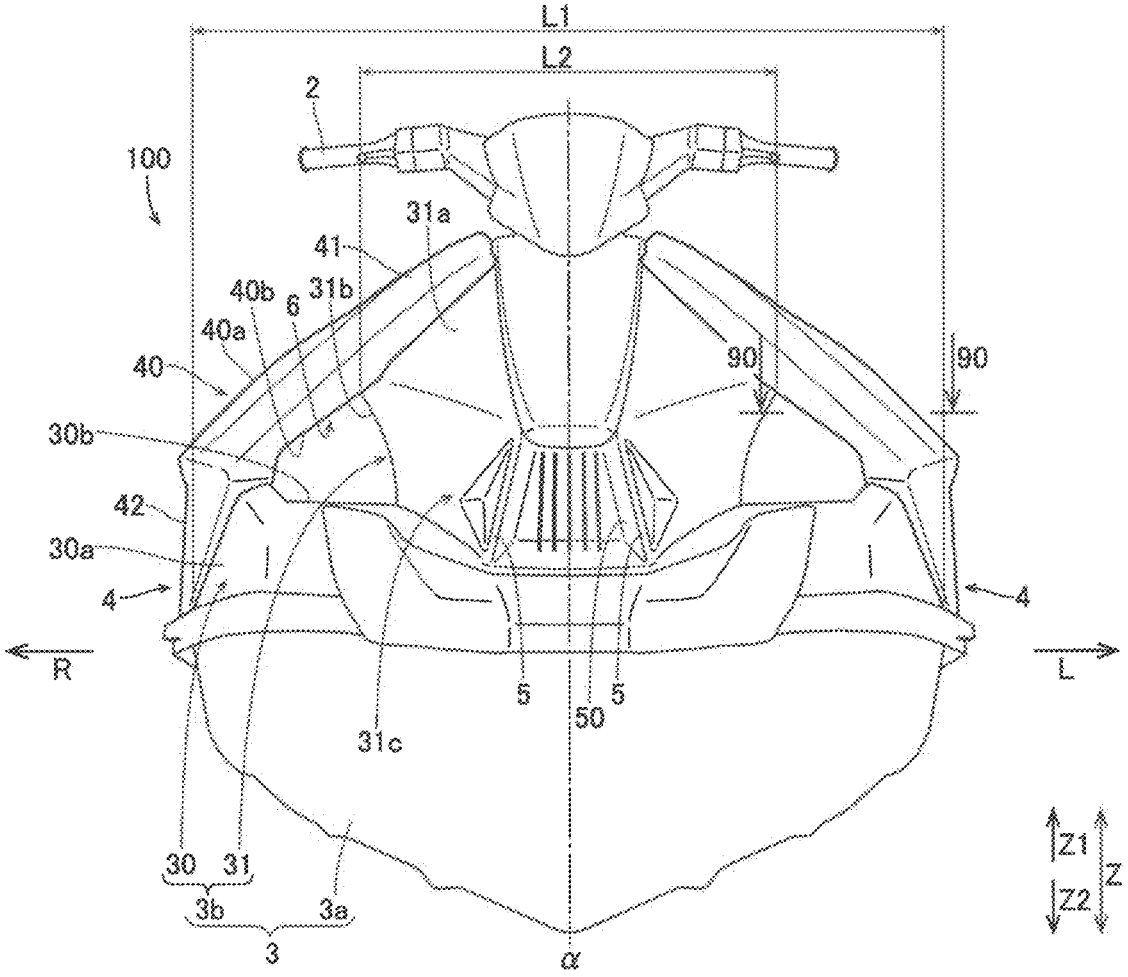
FIG. 5 is a front view of a jet propelled boat according to a preferred embodiment of the present invention.

As shown in FIG. 5, the through-holes 6 are defined by the side surfaces 31*b* of the upper deck 31, the upper surface 30*b* of the lower deck 30, and the inner surfaces 40*b* of the connectors 40 that face the deck 3*b* and are located inward. The through-holes 6 substantially extend in the forward-rearward direction between the deck 3*b* and the frames 4 (connectors 40).

The side surfaces 31*b* of the upper deck 31 that define the through-holes 6 are concave so as to be recessed inward. Specifically, the concave side surfaces 31*b* of the upper deck 31 that define the through-holes 6 are arcuate.

As shown in FIG. 1, the reinforcing ribs 5 are provided at the front end of the deck 3*b* and are sandwiched between the pair of frames 4 in the front view. The reinforcing ribs 5 extend in the upward-downward direction, and a pair of reinforcing ribs 5 are aligned (spaced apart) in the right-left direction. The pair of reinforcing ribs 5 are located line-symmetrically with respect to a centerline a (see FIG. 5) of the jet propelled boat 100 in the right-left direction. A recess 50 that is recessed rearward is provided between the pair of reinforcing ribs 5.

The pair of reinforcing ribs 5 are spaced farther apart from each other toward the lower side such that a distance between the pair of reinforcing ribs 5 in the right-left direction increases.

According to the various preferred embodiments of the present invention described above, the following advantageous effects are achieved.

According to a preferred embodiment of the present invention, the jet propelled boat 100 includes the pair of frames 40, one frame provided on each of the right side and the left side of the deck 3*b* so as to sandwich the deck 3*b* in the right-left direction of the jet propelled boat and including the connector 40 that spans the upper deck 31 and the lower deck 30 so as to connect the upper deck 31 to the lower deck 30. Accordingly, the connectors 40 of the frames 4 span the upper deck 31 and the lower deck 30 on both of the right and left sides of the deck 3*b*, and thus the upper deck 31 and the lower deck 30 are less likely to be mutually deformed. Consequently, even when the deck 3*b* encounters water resistance or wind resistance depending on the operating state of the jet propelled boat 100, the deck 3*b* is less likely to deform, and thus the strength of the deck 3*b* is improved.

According to a preferred embodiment of the present invention, the lower deck 30 is larger than the upper deck 31 in the right-left direction, and the connector 40 is inclined downward and outward in the front view. Accordingly, the lower deck 30 and the upper deck 31 are connected to each other by the connector 40 on the upper end sides of the lower deck 30 and the right-left end sides of the upper deck 31, and thus the upper deck 31 and the lower deck 30 are less likely to be deformed. Consequently, the strength of the deck 3*b* is further improved.

According to a preferred embodiment of the present invention, the through-holes 6 are defined by the side surfaces 31*b* of the upper deck 31, the upper surface 30*b* of the lower deck 30, and the inner surfaces 40*b* of the connectors 40 located inward and that face the deck 3*b*. Accordingly, wind passes through the through-holes 6 from the front side such that wind resistance encountered by the deck 3*b* is reduced.

According to a preferred embodiment of the present invention, the connectors 40 are inclined so as to extend forward as the connectors 40 extend downward. Accordingly, the connectors 40 are located so as to not easily interfere with the lower limbs of the user that protrude forward.

According to a preferred embodiment of the present invention, the pair of frames 4 define the cowling together with the front portion 31*c* of the upper deck 31. Accordingly, the frames 4 improve the strength of the deck 3*b*, and significantly reduce or prevent exposure of the user to wind and water splash.

According to a preferred embodiment of the present invention, each of the frames 4 further includes the upper frame 41 that is located above the connector 40, extends along the outer surface 31*a* of the upper deck 31, and is integral and unitary with the connector 40, and the lower frame 42 that is located below the connector 40, extends along the outer surface 30*a* of the lower deck 30, and is integral and unitary with the connector 40. Accordingly, a connection of the connector 40 to each of the upper deck 31 and the lower deck 30 is reinforced by the upper frame 41 and the lower frame 42, and thus the connector 40 more securely spans and connects the upper deck 31 and the lower deck 30.

According to a preferred embodiment of the present invention, the outer surface 42*a* of the lower frame 42 is flush or substantially flush with the outer surface 30*a* of the lower deck 30. Accordingly, wind resistance generated at a boundary between the lower frame 42 and the lower deck 30 is substantially zero.

According to a preferred embodiment of the present invention, each of the frames 4 further includes the rear frame 43 that is connected to the upper frame 41 from the rear side and extends rearward so as to cover the outer surface 31*a* of the upper deck 31. Accordingly, the rear frame 43 covers the outer surface 31*a* of the upper deck 31, and thus the strength of the upper deck 31 is further improved.

According to a preferred embodiment of the present invention, the connector 40 becomes thicker toward the upper side. Accordingly, the connector 40 becomes thicker toward the upper deck 31, which may be easily deformed, as compared with the lower deck 30, which is installed on the hull 3*a* and hard to deform. Therefore, deformation of the upper deck 31 is effectively significantly reduced or prevented such that the strength of the deck 3*b* is effectively improved.

According to a preferred embodiment of the present invention, the side surfaces 31*b* of the upper deck 31 that define the through-holes 6 are concave so as to be recessed inward. Accordingly, the through-holes 6 are larger as compared with a case in which the side surfaces 31*b* of the upper deck 31 that define the through-holes 6 are convex, and thus more air passes through the through-holes 6. Therefore, wind resistance encountered by the deck 3*b* is further reduced.

According to a preferred embodiment of the present invention, the concave side surfaces 31*b* of the upper deck 31 that define the through-holes 6 are arcuate. Accordingly, as compared with a case in which the concave side surfaces 31*b* of the upper deck 31 each have a shape with corners, stress concentrations on the upper deck 31 is significantly reduced or prevented, and thus the strength of the deck 3*b* is further improved.

According to a preferred embodiment of the present invention, the pair of frames 4 have a V-shape so as to be spaced farther apart from each other toward the front side in the plan view. Accordingly, as compared with a case in which the pair of frames 4 extend only in the upward-downward direction or only in the right-left direction in the plan view, the frames 4 are installed over a relatively large range in the plan view, and thus the deck 3*b* is reinforced over a relatively large range in the plan view.

According to a preferred embodiment of the present invention, the outer surface 40*a* of the connector 40 is convex so as to bulge outward as a whole in the horizontal cross-section. Accordingly, the mechanical strength of the deck 3*b* is improved as compared with a case in which the outer surface 40*a* is flat. Furthermore, light reflection directions of the outer surface 40*a* are larger as compared with a case in which the outer surface 40*a* is flat, and thus the visibility of the connector 40 (jet propelled boat 100) for a person other than the user of the jet propelled boat 100 is improved.

According to a preferred embodiment of the present invention, the convex outer surface 40*a* includes the two concave surfaces 401 aligned in the forward-rearward direction and recessed inward in the horizontal cross-section, and one convex portion 402 that connects the two concave surfaces 401 and bulges outward in the horizontal cross-section. Accordingly, a convex connector 40 that bulges outward is easily provided.

According to a preferred embodiment of the present invention, the deck 3*b* includes the footrests 32 on which the user's feet are placed, and the connectors 40 are located on the front sides of the footrests 32 in the forward-rearward direction. Accordingly, the connectors 40 are located on the front sides of the footrests 32 such that exposure of the lower limbs of the user to wind is reliably significantly reduced or prevented.

According to a preferred embodiment of the present invention, the jet propelled boat 100 further includes the pair of reinforcing ribs 5 that are provided at the front end of the deck 3*b*, sandwiched between the pair of frames 4 in the front view, extend in the upward-downward direction, and are aligned in the right-left direction. Accordingly, in addition to the strength of the deck 3*b* on both of the right and left sides, the strength of the deck 3*b* on the front side is improved by the reinforcing ribs 5, and thus the strength of the deck 3*b* is further improved.

According to a preferred embodiment of the present invention, the pair of reinforcing ribs 5 are spaced farther apart from each other toward the lower side such that the distance between the pair of reinforcing ribs 5 in the right-left direction increases. Accordingly, the reinforcing ribs 5 reinforce the deck 3*b* more effectively.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the jet propelled boat is preferably a two-seater in preferred embodiments described above, the present invention is not restricted to this. In the present invention, the jet propelled boat may alternatively be a one-seater.

While the jet propelled boat preferably includes the seat in preferred embodiments described above, the present invention is not restricted to this. In the present invention, the jet propelled boat may not include the seat.

While each of the frames preferably includes the connector, the upper frame, the lower frame, and the rear frame in preferred embodiments described above, the present invention is not restricted to this. In the present invention, each of the frames may alternatively include only the connector, or each of the frames may alternatively include the connector and at least one of the upper frame or the lower frame.

While the frames are preferably located on the front side in preferred embodiments described above, the present invention is not restricted to this. In the present invention, the frames may alternatively be located on the rear side.

While the reinforcing ribs are preferably provided on the deck in preferred embodiments described above, the present invention is not restricted to this. In the present invention, the reinforcing ribs may not be provided on the deck.

While each of the frames preferably includes a hollow structure in preferred embodiments described above, the present invention is not restricted to this. In the present invention, each of the frames may alternatively include a solid structure.

While the frames preferably extend forward and downward in preferred embodiments described above, the present invention is not restricted to this. In the present invention, the frames may alternatively extend in the upward-downward direction.

While openings are preferably provided between the frames (connectors) and the deck in preferred embodiments described above, the present invention is not restricted to this. In the present invention, openings may not be provided between the frames (connectors) and the deck.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet propelled boat comprising:

a boat body including a hull and a deck located above the hull; and a pair of frames provided respectively on a right side and a left side of the deck so as to sandwich the deck in a right-left direction of the jet propelled boat; wherein the deck includes an upper deck and a lower deck; and each of the pair of frames includes a connector to connect the upper deck to the lower deck; wherein an opening is provided in each of the pair of frames and defined by a side surface of the upper deck, an upper surface of the lower deck, and an inner surface of the connector of each of the pair of frames that faces the deck.

2. The jet propelled boat according to claim 1, wherein the lower deck is larger than the upper deck in the right-left direction; and the connector of each of the pair of frames is inclined downward and outward in a front view of the jet propelled boat.

3. The jet propelled boat according to claim 1, wherein the connector of each of the pair of frames is inclined forward and downward toward a lower side of the jet propelled boat.

4. The jet propelled boat according to claim 1, wherein the pair of frames define a cowling together with a front portion of the upper deck.

5. The jet propelled boat according to claim 1, wherein each of the pair of frames further includes:

an upper frame integral and unitary with the connector and located above the connector and along an outer surface of the upper deck; and a lower frame integral and unitary with the connector and located below the connector and along an outer surface of the lower deck.

6. The jet propelled boat according to claim 5, wherein the lower frame of each of the pair of frames includes an outer surface flush or substantially flush with the outer surface of the lower deck.

7. The jet propelled boat according to claim 6, wherein each of the pair of frames further includes a rear frame connected to a rear side of the upper frame and extending rearward so as to cover the outer surface of the upper deck.

8. The jet propelled boat according to claim 1, wherein the connector of each of the pair of frames becomes thicker as the connector extends upward toward an upper side of the jet propelled boat.

9. The jet propelled boat according to claim 1, wherein the side surface of the upper deck that defines the opening in each of the pair of frames is concave so as to be recessed inward.

10. The jet propelled boat according to claim 9, wherein the concave side surface of the upper deck that defines the opening in each of the pair of frames is arcuate.

11. The jet propelled boat according to claim 1, wherein the pair of frames have a V-shape so as to be spaced farther apart from each other as the pair of frames extend toward a front side of the jet propelled boat in a plan view.

12. The jet propelled boat according to claim 1, wherein the connector of each of the pair of frames includes an outer surface that is convex so as to bulge outward in a horizontal cross-section of the jet propelled boat.

13. The jet propelled boat according to claim 12, wherein the convex outer surface includes two concave surfaces aligned in a forward-rearward direction of the jet propelled boat and recessed inward in the horizontal cross-section, and one convex portion that connects the two concave surfaces and bulges outward in the horizontal cross-section.

14. The jet propelled boat according to claim 1, wherein the deck further includes a footrest to enable a user to place his or her foot thereon; and the connector of each of the pair of frames is located on a front side of the footrest in a forward-rearward direction of the jet propelled boat.

15. The jet propelled boat according to claim 1, further comprising:

a pair of reinforcing ribs aligned in the right-left direction so as to extend in an upward-downward direction of the jet propelled boat at a front end of the deck between the pair of frames in a front view.

16. The jet propelled boat according to claim 15, wherein the pair of reinforcing ribs extend outward and downward away from each other toward a lower side of the jet propelled boat.

* * * * *